US005885058A

United States Patent [19]

Vilagines et al.

[11] Patent Number: 5,885,058

[45] Date of Patent: Mar. 23, 1999

[54] MULTIPHASE FLUID PUMPING OR COMPRESSION DEVICE WITH BLADES OF TANDEM DESIGN

[75] Inventors: Régis Vilagines, Vernaison; Christian Bratu, Les Vergers de la Ranchère; Florent Spettel, Neuville Sur Saone, all of France

[73] Assignee: Institute Francais du Petrole, Rueil Malmaison, France

[21] Appl. No.: 777,065

[22] Filed: Dec. 30, 1996

[30] Foreign Application Priority Data

Dec. 28, 1995 [FR] France ..... 95 15624

[51] Int. Cl.[6] ..... F04D 29/44

[52] U.S. Cl. ..... 415/199.1

[58] Field of Search ..... 415/199.1, 199.3, 415/198.1

[56] References Cited

U.S. PATENT DOCUMENTS 2,576,700 11/1951 Schneider .
3,918,841 11/1975 Kida et al. .

FOREIGN PATENT DOCUMENTS 0348342 of 1989 European Pat. Off. .
982027 of 1951 France .
1404875 of 1965 France .
2157437 of 1973 France .
233139 of 1977 France .
2471501 of 1981 France .
2665224 of 1992 France .
19 31 527 of 1970 Germany .
2168764 of 1986 United Kingdom .
2193533 of 1988 United Kingdom .
89 04644 of 1989 WIPO .

*Primary Examiner*—John T. Kwon
*Attorney, Agent, or Firm*—Antonelli, Terry, Stout & Kraus, LLP

[57] ABSTRACT

The invention is a device for providing one of compressing and pumping of a multiphase fluid including at least one liquid phase and at least one gaseous phase. The device includes at least one hollow casing having at least one inlet port and at least one outlet port for the fluid. At least one rotor is rotated and mounted inside the casing having an axis OX in a hub. The at least one rotor comprises at least one impeller or at least one diffuser having at least two vanes $G_j$ having a first blade $A_{1j}$ and a second blade $A_{2j}$ wherein geometric characteristics and position of at least one of the first blade $A_{1j}$ and at least one second blade $A_{2j}$ in relation to each other is determined according to at least one parameter.

16 Claims, 6 Drawing Sheets

MULTIPHASE FLUID PUMPING OR COMPRESSION DEVICE WITH BLADES OF TANDEM DESIGN

BACKGROUND OF THE INVENTION

1. Field of the Invention

The present invention relates to a device intended for the compression of multiphase fluids which, prior to being compressed and under the pressure and temperature conditions considered, consist of a mixture of notably a liquid phase and a gas phase that are not dissolved in the liquid, and this liquid may or may not be gas-saturated.

2. Description of the Prior Art

Whatever the design of the pumps used (reciprocating pumps, rotary pumps or horn effect pumps), good results are obtained when the value of the volumetric ratio of the fluid is very low or even zero, because the fluid then acts as a liquid single-phase fluid. These materials can be used when their operating conditions cause no phenomena likely to allow vaporization of a large part of the gas dissolved in the liquid, or when the value of the volumetric ratio at the pump inlet is at most 0.2. It is known from experience that, above this value, the effectiveness of these devices decreases very quickly.

In order to improve the operation of existing devices, a solution consists in separating the liquid phase from the gas phase prior to pumping, and in processing the phases separately, in distinct compression circuits respectively suited to communicate a compression value to a mainly liquid phase or to a mainly gaseous phase. Separate circuits cannot always be used and often lead to bigger, more expensive and more complex pumping systems.

This is the reason why attempts have been made to develop pumping devices suited not only to increase the total energy of the multiphase fluid, but also capable of producing a multiphase fluid whose volumetric ratio value at the outlet of the pumping device is below the value thereof prior to pumping.

The prior art describes various blade profiles allowing the obtaining of this result, notably the Assignee's French Patents 2,157,437, 2,333,139, 2,471,501 and 2,665,224, which describe precise blade profiles or a geometry selected for the section of flow of the fluid defined by two successive blades. In any case, these profiles relate to simple blades comprising a single piece, unlike the blades referred to as "blades of tandem design" which comprise at least two blades within a single group.

The performances of multiphase fluid pumping with "simple" blades can be improved.

The prior art thus describes, for example in the article "Optimization for Rotor Blades of Tandem Design for Axial Flow Compressors" published in the Journal of Engineering for Power, Vol.102, p.369, in April 1980, the use of compression devices comprising blades of tandem design.

However, the teaching of this prior art only relates to the compression of single-phase fluids, i.e. fluids that, at the inlet of the compression device, mainly consist of a single phase, either liquid or gaseous. The geometric characteristics of the blades of tandem design described in this document are particularly well-suited for the compression of a single-phase fluid whose behaviour in compression can nevertheless not be compared to the behaviour of a fluid having several phases, for example fluids with at least one liquid phase and at least one gas phase, and they are therefore not suited for pumping a multiphase fluid.

It has been discovered, which is one object of the present invention, that pumping of a multiphase fluid can be improved by using blades of tandem design or "tandem blades" whose geometric configuration is suited to compress a multiphase fluid comprising at least one liquid phase and at least one vapor or gas phase, the proportions of these two phases being likely to vary with time.

In the description hereafter, the skeleton of a blade is defined as the surface which is equidistant at any point to the lower face of the blade and the upper face of the blades.

Considering the intersection of a blade with a surface of the flowing fluid around this blade, a profile for the blade may be defined from geometrical coordinates of the line of the curvature of the blade and the way it varies with the thickness of the blade along this line.

SUMMARY OF THE INVENTION

In order to obtain the improvement mentioned above, the device according to the present invention uses blades of tandem design comprising vanes made up of one or more profiles or blades.

$A_j$: refers to a blade bearing number i in the group of blades j, $a_{ij}$: refers to the leading edge of a blade $A_{ij}$, $f_{ij}$: trailing edge of a blade $A_{ij}$, $G_j$: refers to the group of blades, $C_{Tj}$: total chord of a group of blades corresponding to the chord defined from a blade having a profile equivalent to the profile determined from all of the blades, $C_{Fj}$: chord of the first blade of a group of blades, $C_{Rj}$: chord of the second blade of a group of blades, for groups comprising two blades but that could be increased to a number greater than 2 without departing from the scope of the invention, h refers to the tangential offset corresponding to the projection of distance ($f_{ij}$, $a_{ij}$) on the peripheral direction (perpendicular to the rotation axis), $\alpha$ is the angle defined on substantially coaxial constant-radius, cylindricals, whose axis is on these surfaces, a is the angle between the peripheral direction (perpendicular to the axis rotation) and the tangent to any point at the curve defined by the previous defined skeleton.

For example, when the vane or the group of blades $G_j$ comprises two blades $A_{1j}$ and $A_{2j}$, the first blade for example referred to as main blade is the first to receive the flowing fluid or fluid particle, and the second blade is for example referred to as auxiliary blade.

The compression device or compression cell according to the invention is particularly well-suited for pumping a multiphase fluid, for example, but not exclusively, a multiphase petroleum effluent consisting of a mixture of water, oil and gas, and possibly of solid particles. Pumping of such a fluid poses problems that are all the more difficult to solve since the value of the gas/liquid volumetric ratio is higher under the thermodynamic conditions of the fluid before pumping.

It should be noted that the gas/liquid volumetric ratio, referred to in a shortened form hereafter as "volumetric ratio" or GLR (Gas/Liquid Ratio), is defined as the ratio of the volume of fluid in the gaseous state to the volume of fluid in the liquid state, the value of this ratio depending notably on the thermodynamic conditions of the multiphase fluid.

The particular geometric characteristics of each of these blades and the way they are arranged in relation to each other allows the optimizing of the compression of a multiphase fluid and the re-mixing of at least part of the liquid phase coming from a first group of blades with at least part of the gas phase coming from the previous group of blades.

The various blades forming a vane can be totally separated from each other or be part of a blade provided with openings or transfer ports, and each one of the parts separated by these ports can be classed as a blade.

The present invention thus relates to a device for compressing or for pumping a multiphase fluid comprising at least one liquid phase and at least one gas phase, the device comprising at least one hollow casing having at least one inlet port and at least one outlet port for the fluid, at least one rotor that can rotate inside the casing with an axis of rotation Ox, the rotor having of a hub and of at least one vane $G_j$ secured to the hub. The vane $G_j$ comprises a first blade $A_{1j}$ and a second blade $A_{2j}$, each of these blades having a leading edge $a_{ij}$ and a trailing edge $f_{ij}$, the angle $\alpha$ formed by the tangent a curve of the skeleton, the angle being defined from the leading edge $a_{ij}$ of at least the first and/or second blade ($A_{1j}$, $A_2$,) is for example comprised between 0° and 45°.

It should be noted, hereafter, that the skeleton of a blade is defined as the surface which is at any point equivalent for the intrado blades and the extrado blades. Considering the intersection of a blade with a surface of the flowing around the blade, a profile of the blades may be described with geometrical coordinates of the line of curvature and the rule of distribution of the blade's thickness along this line.

According to an embodiment, the device comprises at least one impeller comprising at least two vanes or group of blades $G_1$, $G_2$ comprising each a first blade $A_{1j}$ and a second blade $A_{2j}$, the geometric characteristics of the first and/or of the second blade of each group of blades $G_j$ and the positioning of the various groups of blades in relation to each other are determined for example according to at least one parameter selected from the four parameters as follows:

parameter 1: the tangential offset h in relation to the pitch t, expressed in the form of the ratio h/t, where t is the pitch corresponding to the distance between the two trailing edges $f_{21}$ and $f_{22}$ corresponding to the second blades $A_{21}$ and $A_{22}$ of each group of blades $G_1$ and $G_2$, the value of parameter 1 is in the [0.95; 1.05] range, parameter 2: the ratio of the axial lap $r_j$ and of the total chord $C_{Tj}$ corresponding to a group of blades $G_j$ that is in the [0.01; 0.15] value range, parameter 3: the chord ratio $R_{Cj}=(C_{Fj}/C_{Rj})$ defined, for a group of blades $G_j$, by the ratio of the value of the chord $C_{Fj}$ of the first blade to the value of the chord $C_{Rj}$ of the second blade for one of the groups of blades, between [0.5; 1.5], and parameter 4: the camber ratio $\Phi_j$ defined by the value of the camber $\Phi_{Fj}$ of the first blade to the value of the camber $\Phi_{Rj}$ of the second blade of the same group of blades lies in the [0.10; 1] range.

According to an embodiment, the device comprises at least one straightener comprising each a first blade $A_1$j and a second blade $A_{2j}$, the geometric characteristics of the first and/or of the second blade of each group of blades $G_j$ and the positioning of the various groups of blades in relation to each other are determined for example according to at least one parameter selected from the four parameters as follows:

parameter 1: the tangential offset h in relation to the pitch t, expressed in the form of the ratio h/t, where t is the pitch corresponding to the distance between the two trailing edges $f_{21}$ and $f_{22}$ corresponding to the second blades $A_{21}$ and $A_{22}$ of each group of blades $G_1$ and $G_2$, the value of parameter 1 is in the [0.60; 0.80] range, parameter 2: the ratio of the axial lap $r_j$ and of the total chord $C_{Tj}$ corresponding to a group of blades $G_j$ that is in the [−0.01; 0.05] value range, parameter 3: the chord ratio $R_{Cj}=(C_{Fj}/C_{Rj})$ defined, for a group of blades $G_j$, by the ratio of the value of the chord $C_{Fj}$ of the first blade to the value of the chord $C_{Rj}$ of the second blade for one of the groups of blades, between [0.5; 1.5], parameter 4: the camber ratio $\Phi_j$ defined by the value of the camber $\Phi_j$ of the first blade to the value of the camber $\Phi_{Rj}$ of the second blade of the same group of blades lies in the [0.10; 1] range.

The device comprises for example at least one impeller and/or one straightener or diffuser, each comprises at least two groups of blades $G_1$, $G_2$ comprising for example each a first blade ($A_{11}$, $A_{12}$) and a second blade ($A_{21}$, $A_{22}$), the geometric characteristics of the first and second blade of each group of blades and the positioning of the various groups of blades in relation to each other are determined for example according to three of the parameters.

The geometric characteristics of at least one impeller and/or at least one straightener are for example defined by a fourth parameter, the value of the camber ratio $\Phi_j$ being selected in combination with the three values of the parameters previously mentioned and chosen according to an impeller or a straightener.

The ratio of the maximum thickness of the first and/or of the second blades e1/e2 ranges for example between 0.5 and 1, for one impeller and/or a diffuser.

The thickness e1 of the first blade ranges for example between 2 and 10 mm and/or the thickness e2 of the second blade ranges between 2 and 20 mm.

According to an embodiment, one vane is for example secured to a vane placed before and/or to vane placed after, with a mechanical mean, for example.

The device comprises for example at least one impeller, and at least one straightener, the impeller being for example placed before the diffuser considering direction of flow.

According to an embodiment, the device comprises for example at least one impeller, and at least two diffusers, the impeller being for example placed between the two diffusers.

The invention relates also to a device for compressing or for pumping a multiphase fluid comprising at least one gas phase and at least one liquid phase, the device comprising a hollow casing having an inlet port and an outlet port for the multiphase fluid, at least one rotor that can rotate inside the casing with an axis of rotation Ox, the rotor having a hub and of at least one vane secured to this hub, the vane comprising a first face or top face and a second face or lower face. The vane is provided over at least part of its length with one or several openings allowing communication of lower and top faces in order to favour the encounter of at least part of the gas phase flowing next to the top face and of at least part of the liquid phase circulating on the lower face side.

The present invention relates also to a multiphase pump used for example to pump for example a multiphase petroleum effluent. The multiphase fluid comprises at least one impeller and/or at least one straightener showing one of the previous characteristic.

Compared with devices comprising "simple" blades, the tandem design applied notably to the pumping of a multiphase fluid such as a petroleum effluent, in an optimized configuration defined above, brings the following advantages to the compression device:

it allows to minimizing of the separation of the liquid and gas phases contained in the effluent by favouring at least partially their phase re-mixing, water power losses are minimized because:

the blades are better suited to the incidence of the flow entering the compression device, the deceleration rate of the fluid, which is high in case of great blade cambers and notably leads to an increase in water losses and flow separation risks is minimized thereby, and at the level of the stator, the tandem design of the blades improves fluid guidance and thus allows the velocities of the fluid trickles to be evened out in the outlet section.

BRIEF DESCRIPTION OF THE DRAWINGS

Other features and advantages of the invention will be clear from reading the description given hereafter by way of embodiment examples within the scope of non limitative applications to the compression or pumping of a multiphase effluent of petroleum type, comprising at least one liquid phase, one gas phase and possibly a solid phase, with reference to the accompanying drawings in which.

DESCRIPTION OF THE EMBODIMENS OF THE INVENTION

In the description hereafter, the word "fluid" refers to a multiphase fluid comprising notably a liquid phase and a gas phase, and possibly a solid phase in the form of solid particles, for example sand, or viscous particles such as hydrate agglomerates. The liquid phase can notably comprise liquids of different natures, and the gas phase can comprise gases of different natures.

The fluid comprises phases of different natures inside and outside the compression device, unlike single-phase fluids which can undergo transformations inside the device.

Figure 1:
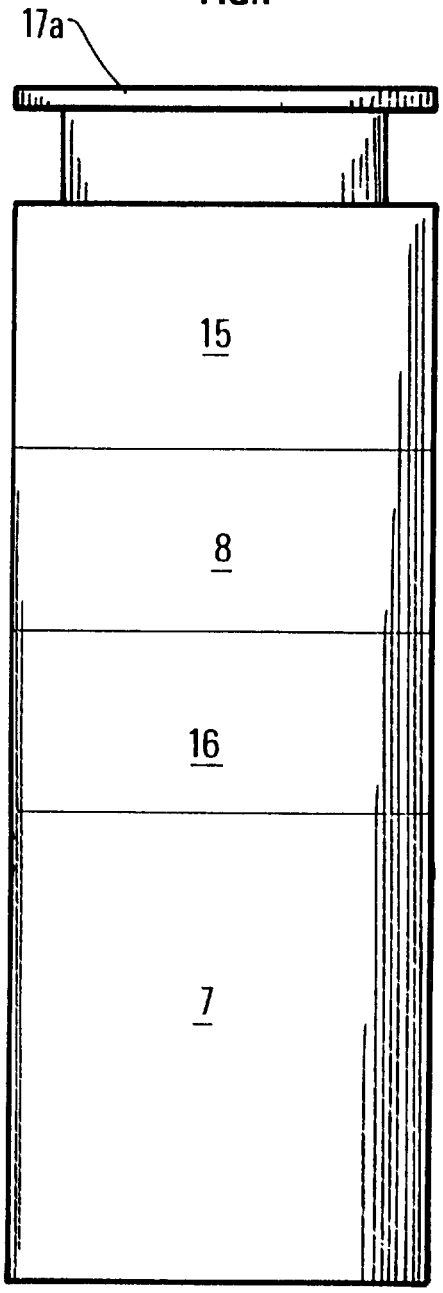
FIGS. 1 and 1A diagrammatically show, in axial section, a particular embodiment of the device according to the invention intended for pumping of a multiphase effluent.
Figure 1A:
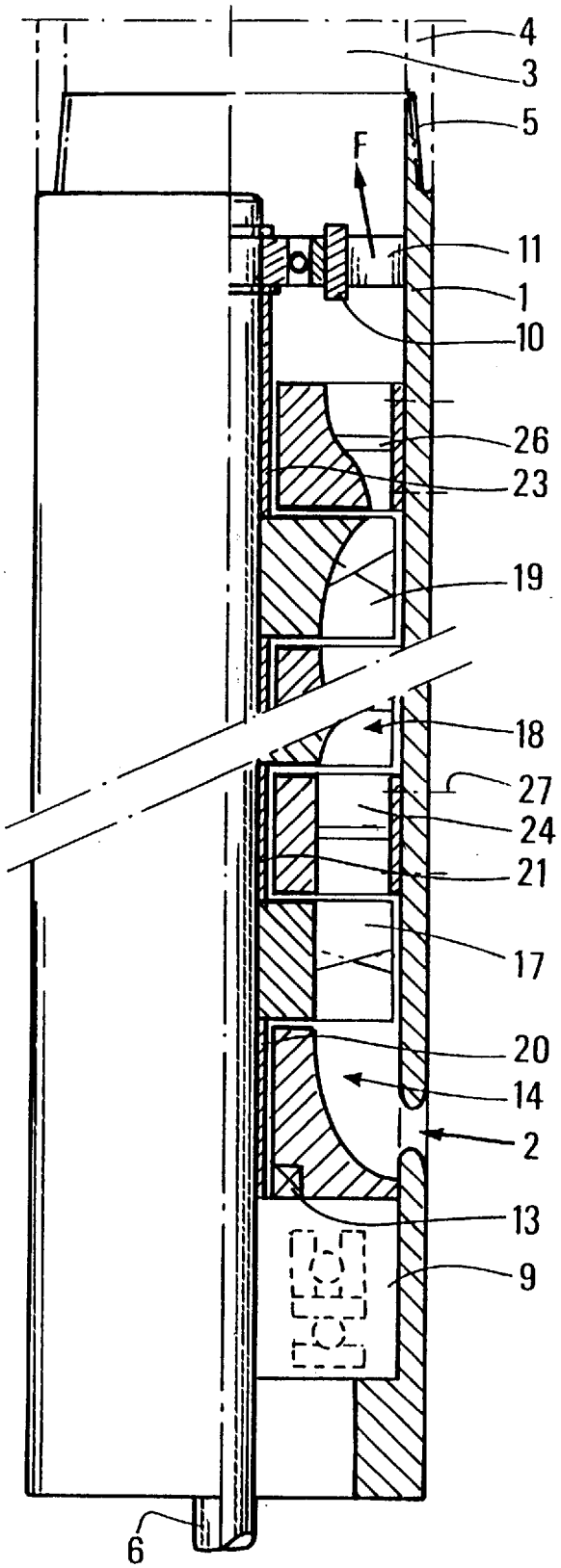

FIGS. 1 and 1A diagrammatically show, in axial section, a particular and non limitative embodiment of the device according to the invention intended for pumping a multiphase petroleum effluent.

The pumping device comprises a hollow casing 1 that is for example cylindrical in order to be readily run into a well, for non limitative applications of the device according to the invention relative to the pumping of effluents in a production well. Casing 1 is provided with at least one multiphase fluid inlet port 2 and with at least one discharge port 3 that communicates with the flow circuit of the fluid pumped. This circuit is represented by a line or pipe 4 at the end of which casing 1 is fastened by any suitable means known in the art, for example a thread bearing reference number 5 in the figure.

In the example illustrated by FIG. 1A, inlet 2 exhibits the form of ports provided in the wall of casing 1 and the pumping device comprises, at the level of these ports, a deflector 14 secured to casing 1 in order to deflect the fluid after its entry in the casing and to transmit a velocity having a substantially axial direction thereto, i.e. substantially parallel to the axis of rotation of the pump.

A rotor comprising a shaft 6 driven into rotation by motive means 7 (FIG. 1) such as, for example but not exclusively, an electric motor, and possibly a transmission device 8 (FIG. 1) allowing variation of the rotational speed of the shaft of the motor to the rotational speed at which shaft 6 is to be driven, are placed in casing 1.

Shaft 6 is for example held in position by at least two distinct bearings 9 and 10 for example described in the Assignee's French Patent 2,471,501.

Bearing 10 is fastened to casing 1 by radial arms 11 so that the gaps between these radial arms allow the fluid to flow in the direction shown by arrow $\vec{F}$.

Details concerning the mounting of bearings 9 and 10 are given explicitly in French patent FR-2,471,501, notably mountings allowing the obtaining of a seal between the various parts of the device, which are sufficiently in the art and need not be described in detail hereafter.

At least one element or stage suited to increase the total energy of the fluid is placed between the inlet 2 and outlet 3 ports of the pumping device and in casing 1.

FIG. 1 shows three elements whose function is to increase the energy of the fluid, bearing reference numbers 17, 18 and 19. This number is not limitative and depends on the desired pressure increase. These elements are referred to hereafter as impellers.

Figure 3:
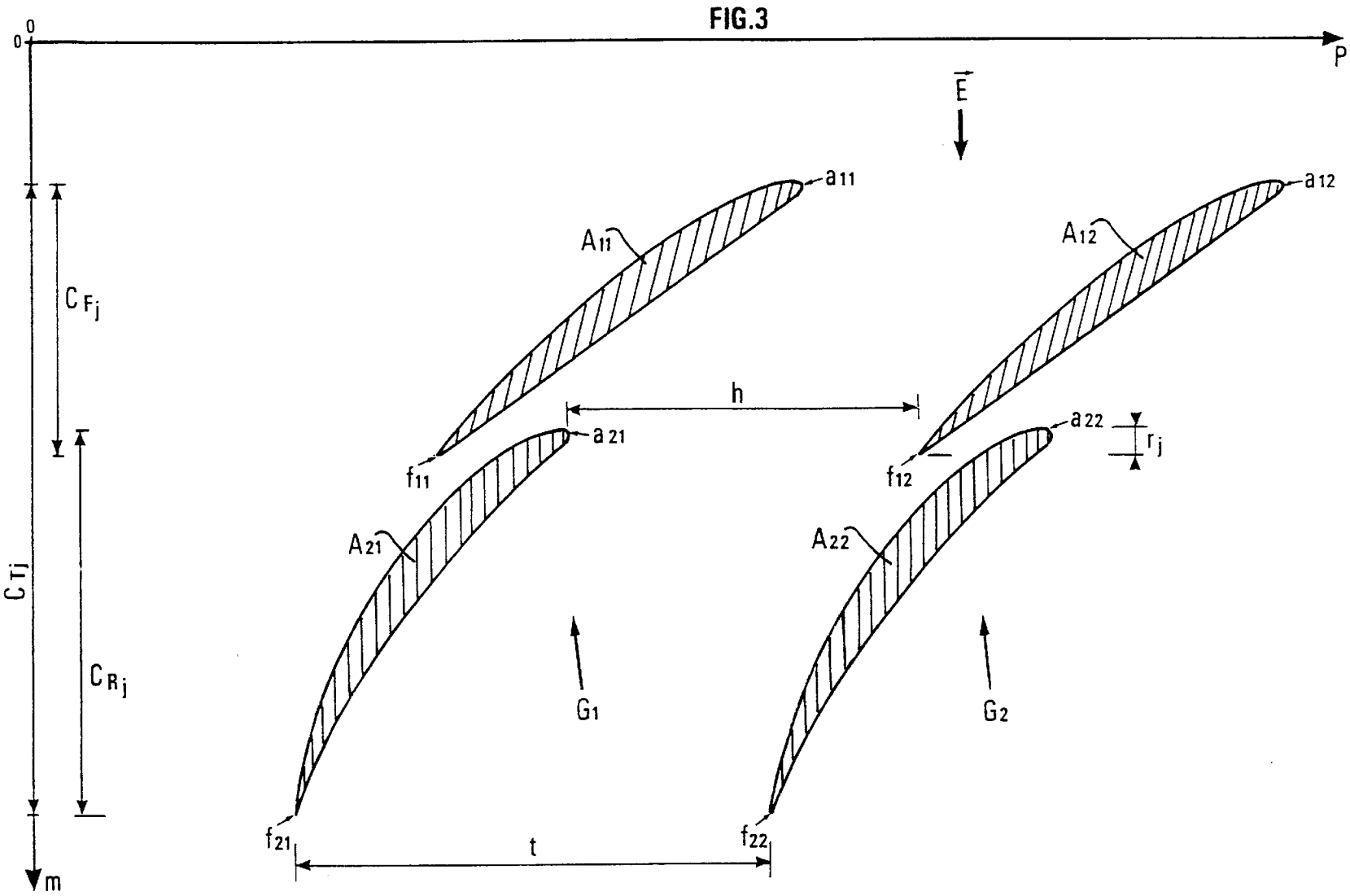
FIG. 3 is a trace resulting from the intersection of the vanes with a cylindrical surface of fixed radius, showing the parameters defining a tandem blade geometry according to the invention, FIG. 4 diagrammatically shows the mixing of the flows of the gas phase and of the liquid phase, FIG. 5 diagrammatically shows an embodiment of the device where the group of blades are connected together with a mechanical element.

These elements, described hereafter in detail in FIG. 3, are secured to shaft 6 on which they are for example press fitted, the spacing between the elements being provided by braces 20 to 23.

The device preferably also comprises one or more straightening elements. For example, a straightener (24, 25, 26) is placed at the outlet of each pressure-raising element (17, 18, 19), each straightener being secured to casing 1, for example by means of fastening screws 27.

The presence of straighteners is not necessary to implement the device according to the invention. However, it offers an advantage that can be significant since it allows the guiding of the fluid or effluent through the various stages of the compression device.

Clearances between the pressure-raising elements and the casing and clearances between the pressure-raising elements and the straighteners are of course reduced in a well-known way to their minimum value compatible with the operation of the pump.

Figure 2:
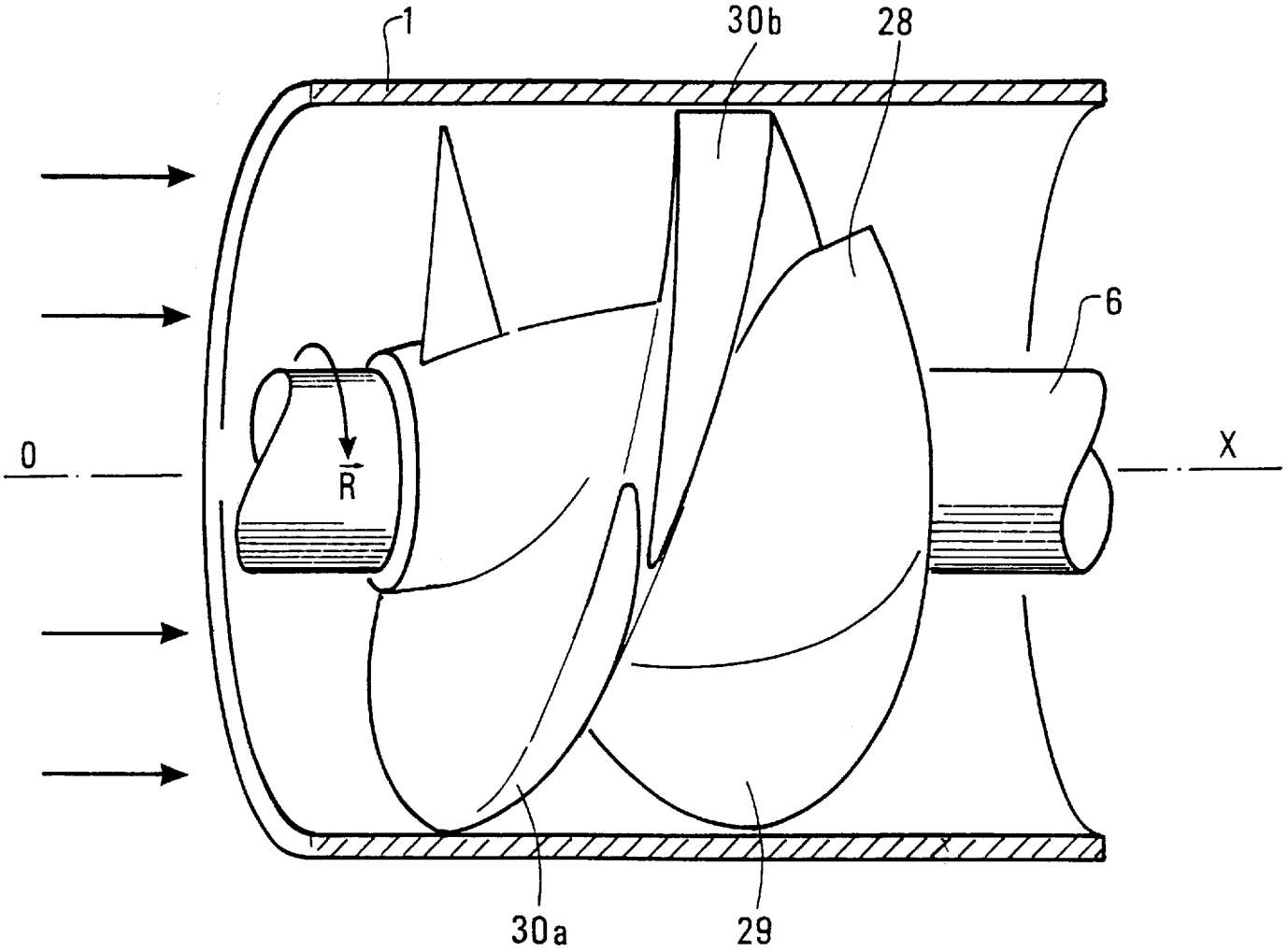
FIG. 2 is a perspective view of an impeller or blade wheel.

FIG. 2 is a perspective view of a non limitative embodiment example of a pressure-raising element or impeller stage mainly comprising a hub 28 secured to shaft 6 which, during operation of the device, is driven into rotation in the direction shown by arrow $\vec{R}$. This hub 28 comprises at least one vane 30 made up of two blades 30*a* and 30*b*, referred to hereafter as first blade or main blade and second blade or auxiliary blade, whose geometric characteristics and positioning in relation to each other are given in connection with FIG. 3. The number of vanes 29, 30 is not limitative and it is given by way of example only. In general, this number is selected to facilitate the static and dynamic balance of the rotor. The height of the vanes is such that the shape they define during their rotation is complementary to the bore which, in this example, is cylindrical.

The effective profile of a tandem vane or of a group of blades corresponding to the profile that the blade would have when made of a single piece can be substantially identical to one of the profiles described in the Assignee's French Patent 2,157,437, 2,333,139, 2,471,501 and 2,665,224, the latter defining the profile of a blade from the section variation of an orthoradial channel defined by two successive vanes. The profile of a tandem vane comprising a first blade 30*a* and a second blade 30*b* can in fact be compared to an effective profile taking account of the profiles of each of the blades. It is thus possible to define an orthoradial channel as the channel defined by two effective vanes or group of blades.

Similarly, each blade of a tandem vane can be selected according to the profiles described in these patents.

The number of tandem vanes, i.e. of groups of blades arranged with a tandem design in relation to each other, is preferably always greater than 2.

Without departing from the scope of the present invention, this number of vanes can range between 3 and 8, preferably between 4 and 6, notably for impellers with vanes of a great outside diameter ranging for example between 200 and 400 mm.

In order to perform and to optimize the compression of a multiphase fluid, the blades forming a vane or a group of blades and the layout of the vanes and/or blades in relation to each other inside the compression device exhibit geometric characteristics determined, for example, by means of at least one of the parameters shown in FIG. 3.

In the example described in FIG. 3, each group of blades $G_j$ comprises for example two blades $A_{1j}$ and $A_{2j}$ arranged one after the other, but this could also be extended to groups of blades comprising a number of blades greater than 2 without departing from the scope of the invention.

The groups of blades are respectively represented in FIG. 3 by $G_1$ and $G_2$. Each group comprises a first blade $A_1$j or main blade and a second blade $A_2$j or auxiliary blade.

A simple representation of a vane has a geometric contour on the developed surface of the cylindrical envelope positioned with respect to the outside radius.

In FIG. 3, the axis of rotation is represented by line m, and line p corresponds to the peripheral or tangential direction of the compression device. Arrow $\vec{E}$ corresponds to the direction of flow of the multiphase fluid entering the compression device.

In a general way, a blade $A_{ij}$ comprises a leading edge bearing reference "$a_{ij}$" in the figure and a trailing edge "$f_{ij}$",where i is the number of a blade $A_{ij}$ in a group of blades bearing index j.

Thus, a first blade bearing index $A_{1j}$ and a second blade bearing index $A_{2j}$ are associated with a group of blades $G_j$, for example, $A_{11}$ corresponds to the first blade of the first group of blades $G_1$ and $A_{21}$ corresponds to the second blade of this group of blades.

The chord is defined for a blade at the distance between its leading edge $a_{ij}$ and its trailing edge $f_{ij}$. It is represented on line m respectively by $C_{Fj}$ for the first blade $A_{1j}$ and $C_{Rj}$ for the second blade $A_{2j}$.

It is also possible to define the total chord length $C_{Tj}$ for a group of blades G represented on line m by the projection of the distance between the leading edge $a_{11}$ of the first blade and the trailing edge $f_{21}$ of the second blade in the same group of blades $G_j$.

The characteristics of the compression device are determined, for example, from at least one parameter selected from a set of characteristic parameters specific to the blades and to the position of the groups of blades. This selection thus allows defining an optimum operating range for the compression device.

The parameters from which these characteristics are selected comprise for example the three parameters as follows:

- the tangential offset h corresponding to the distance between the leading edge $a_{21}$ of the second blade $A_{21}$ of the first group of blades $G_1$ and the trailing edge $f_{12}$ of the first blade $A_{12}$ of the second group of blades $G_2$. The value of this parameter is for example expressed as a function of the pitch t and given in the form of a ratio h/t. Pitch t corresponds to the distance between the two trailing edges $f_{21}$ and $f_{22}$ corresponding to auxiliary blades $A_{21}$ and $A_{22}$ of the first and of the second group of blades $G_1$ and $G_2$,
- the axial lap "$r_j$" with respect the direction m, which corresponds to the lap of the first blade $A_{1j}$ of the group of blades $G_j$ and of the second blade $A_{2j}$ of the same group of blades $G_j$, the relative lap value "$r_j$" being advantageously defined in relation to the chord $C_{Fj}$ of the first blade and of a group of blades,
- the chord ratio $R_{Cj}=(C_{Fj}/C_{Rj})$ defined, for example, by the ratio of the value of the chord $C_{Fj}$ of the first blade to the value of the chord $C_{Rj}$ of the second blade for the group of blades $G_j$.

A suitable selection of the values of at least one of the three parameters defined above allows the obtaining of an optimized compression device.

According to a preferred embodiment of the device, the values of at least one of these parameters is preferably selected in the ranges given hereafter:

To define an impeller, the value of at least one of the three parameters is preferably selected in the ranges given hereafter:

- the ratio of the tangential offset h to the pitch t is in the range [0.95; 1.05],
- the ratio $r_j/C_{Tj}$ is in the range [0.00; 0.15], and
- the chord ratio $R_{Cj}$ ranges between [0.5; 1.5].

It is thus possible to define a geometry for the blades and an arrangement of at least two groups of blades for an impeller allowing the obtaining of an optimum operation of the device intended to compress a multiphase fluid.

Advantageously, the three parameters are selected from the three ranges mentioned above and a fourth parameter selected in combination with the first three parameters is associated therewith to optimize the compression operation. This fourth parameter is for example the camber ratio $\Phi_j$ determined for a group of blades and defined as the ratio of the value of the camber $\Phi_j$ of the first blade $A_{1j}$ to the value of the camber $\Phi_{Rj}$ of the second blade $A_{2j}$ for a given group of blades.

The value of this parameter is preferably selected in the [0.5; 1] range.

Similarly, a straightener or diffuser is defined, by selecting these characteristics in the ranges given hereafter:

- the ratio of the tangential offset h to the pitch t is in the range [0.60; 0.80],
- the ratio $r_j/C_{Tj}$ in the range [−0.01; 0.05], and
- the chord ratio $R_{Cj}$ ranges between [0.5; 1.5].

It is thus possible to define a geometry for the blades and an arrangement of at least two groups of blades for the diffuser allowing to obtain an optimum operation of the device intended to compress a multiphase fluid.

In this case, for the diffuser, the camber ratio $\Phi_j$ determined for a group of blades and defined as the ratio of the value of the camber $\Phi_{Fj}$ of the first blade $A_{1j}$ to the value of the camber $\Phi_{Rj}$ of the second blade $A_{2j}$ for a given group of blades is preferably selected in the [0.10; 1] range.

For an impeller and/or a straightener, an area for the flowing of the fluid is for example defined with the whole area of passage of the fluid, taken in a plan $P_1$ which is perpendicular to the axis of rotation of the device of compression, the plane being placed between the inlet and the outlet of the compression device.

The value of this area varies according to a substantially constant way, and it is limited with a minimum and a maximum value, these two values being chosen so as the ratio of two areas for two plans $P_1$ preferably is in the range [2,2; 0,45].

According to an optimized embodiment, the value for the area of the impeller taken at the outlet plane is defined and limited according to the value of the area of the inside plane.

According to an embodiment, the ratio of the maximum thickness of the first and/of the second blades $e_1/e_2$ ranges between [0,6; 1] for an impeller and preferably ranges between [0,5; 1] for a straightener.

According to a preferred embodiment, the geometric characteristics of the groups of blades for the impellers are defined for example by values so selected that the ratio of the outside diameter of the wheel expressed in mm to the number of vanes belongs to the [40; 60] range.

According to an embodiment of the device, and for example, in a device comprising impeller showing characteristics such as previously described, it is possible without departing from the scope of the invention, to use a straightener well know in the art, the characteristics of straightener being adapted to those of the impeller.

At the outlet of an impeller stage, the multiphase fluid has a velocity having at least an axial component and a circumferential component. As it is well-known, the increasing of the use of a straightener allows to increase the static pressure by suppressing or at least by reducing the circumferential components of the velocity of flow of the fluid.

Without departing from the scope of the invention, arrangements described notably in the Assignee's French Patents 2,333,139, 2,471,501 or 2,665,224 may be used.

For example, a device for compression or a multistage compression device comprises successively several compressor stages, each of these stages comprising for example at least one impeller and a straightener, the straightener being placed before or after the impeller, along the direction of flow of the fluid.

Thus, the area for the flowing of the fluid varies for example in a substantially continuous way, the flowing fluid being for example along the axis of rotation of the device.

Figure 4:
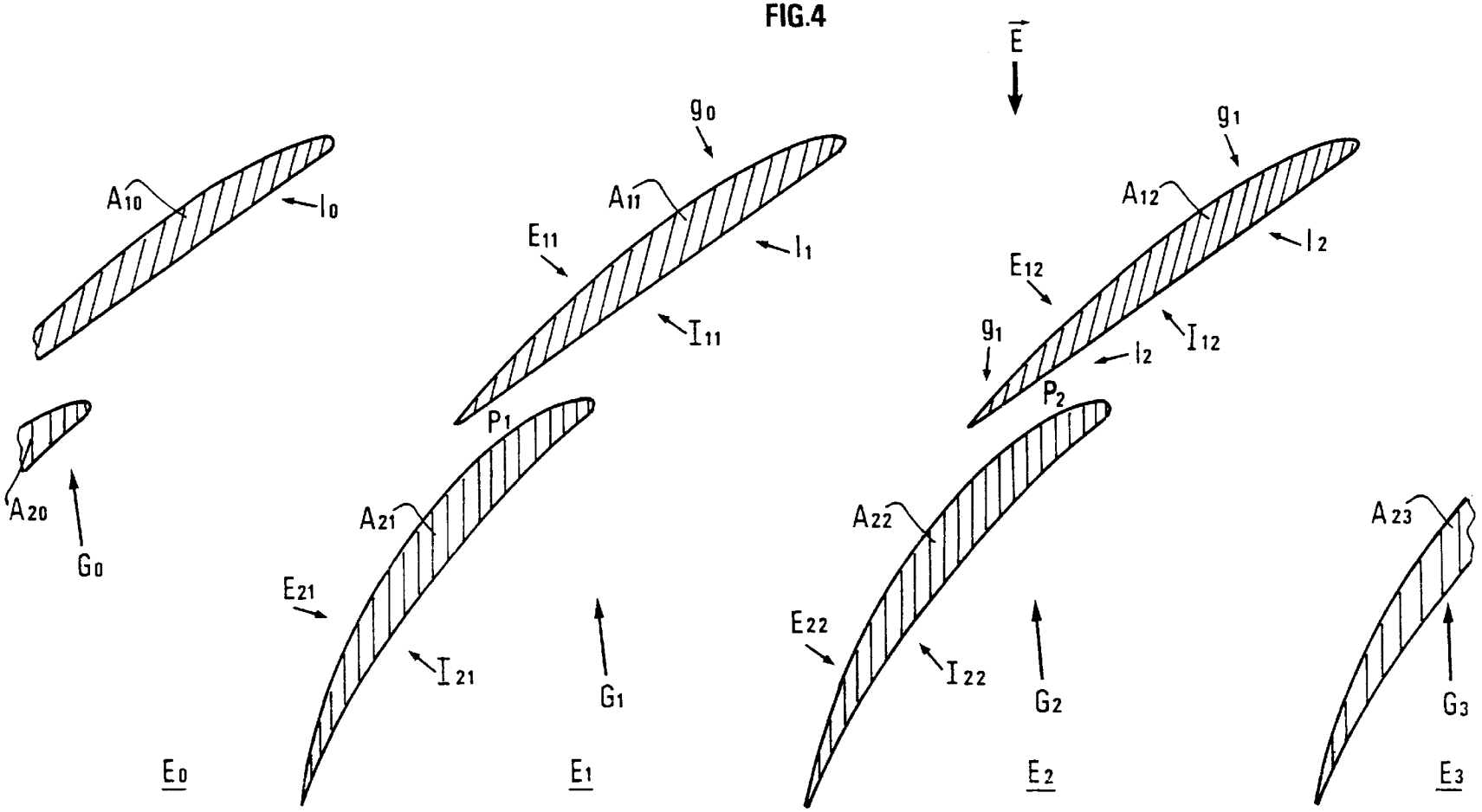

In order to better understand the phenomena occurring during the pumping of a multiphase fluid in a compression device comprising tandem blades, FIG. 4 illustrates the different flows of the various phases, liquid and gaseous, in a pumping or compression device, notably when they flow through a channel delimited by two tandem blades.

FIG. 4 thus shows, in a diagram similar to that of FIG. 3, two groups of blades $G_1$ and $G_2$ and the dotted lines correspond to the groups of blades $G_0$ and $G_3$ placed on either side of the two groups defined above.

Several fluid flow channels $E_0$, $E_1$, $E_2$ respectively situated between the groups of blades $G_0$ and $G_1$, $G_1$ and $G_2$, $G_2$ and $G_3$ are thus defined.

A reference $I_{ij}$ representing the lower face of the blade and a reference $E_{ij}$ representing the top face of the blade are associated with each blade.

For each group of blades, a flow passageway contained between the lower face $I_{1j}$ of the first blade and the top face $E_{2j}$ of the second blade is defined for example.

Thus, in FIG. 4, passageway $p_1$ corresponds to the flow passageway situated between the two blades $A_{11}$, $A_{12}$ of the first group of blades and $p_2$ to the flow passageway situated between the blades $A_{12}$, $A_{22}$ of the second group of blades, the flow passageways having each a width whose value is determined by the positioning of the two blades in a group of blades.

This flow channel allows re-mixing of at least part of the liquid phase coming from a flow channel with at least part of the gas phase circulating in an adjacent flow channel.

In fact, as it flows through a pressure-raising element and under the effect of rotation, a separation of the phases forming the multiphase fluid is observed, notably the separation of the liquid phase and of the gas phase, bearing respectively references $l_k$ and $g_k$, index k being associated with the channel in which the fluid ($E_0$, $E_1$, $E_2$) circulates.

Under the effect of a transverse pressure gradient, the liquid phase $l_k$ is driven towards the face of the overpressured blade, the lower face of the blade, unlike the gas phase $g_k$ that migrates to the underpressured face of the blade or top face. This phenomenon also occurs in compression devices comprising blades referred to as simple blades.

According to the pattern shown in FIG. 4, the multiphase fluid to which a certain energy value is to be transmitted circulates between two groups of successive tandem vanes, for example flow channel $E_1$, and in the direction shown by arrow $\vec{E}$ for example.

Inside this channel, the fluid divides into a liquid fraction $l_1$ that migrates to the lower face $I_{11}$ of blade $A_{11}$ and a gas fraction $g_1$ that is attracted towards the top face $E_{21}$ of the first blade $A_{12}$ of the second group of blades.

The liquid fraction $l_1$ attracted by the lower face $I_{11}$ flows through flow passageway $p_1$ and, also flowing into flow channel $E_0$, continues to circulate until it mixes with at least part of the gas fraction $g_0$ resulting from the separation of the liquid and of the gas phase in flow channel $E_0$.

The gas phase go and the liquid phase $l_1$, while re-mixing, allow to compensate at least partly the phenomenon of segregation of the liquid and gas phase that appears during pumping of a multiphase fluid and that contributes to decreasing the pumping efficiency.

This phenomenon occurs at the level of each of the flow passageways and therefore, at the level of each group of blades, the gaseous and liquid fluids coming for example from adjacent channels are re-mixed.

Advantageously, the presence of a flow passageway between two blades of a group of blades improves substantially the efficiency of the compression devices in relation to the efficiency obtained with a vane consisting of a single blade with a substantially identical equivalent surface and geometry.

The size of the flow passageway is for example selected from the set of parameters defined above.

Figure 5:
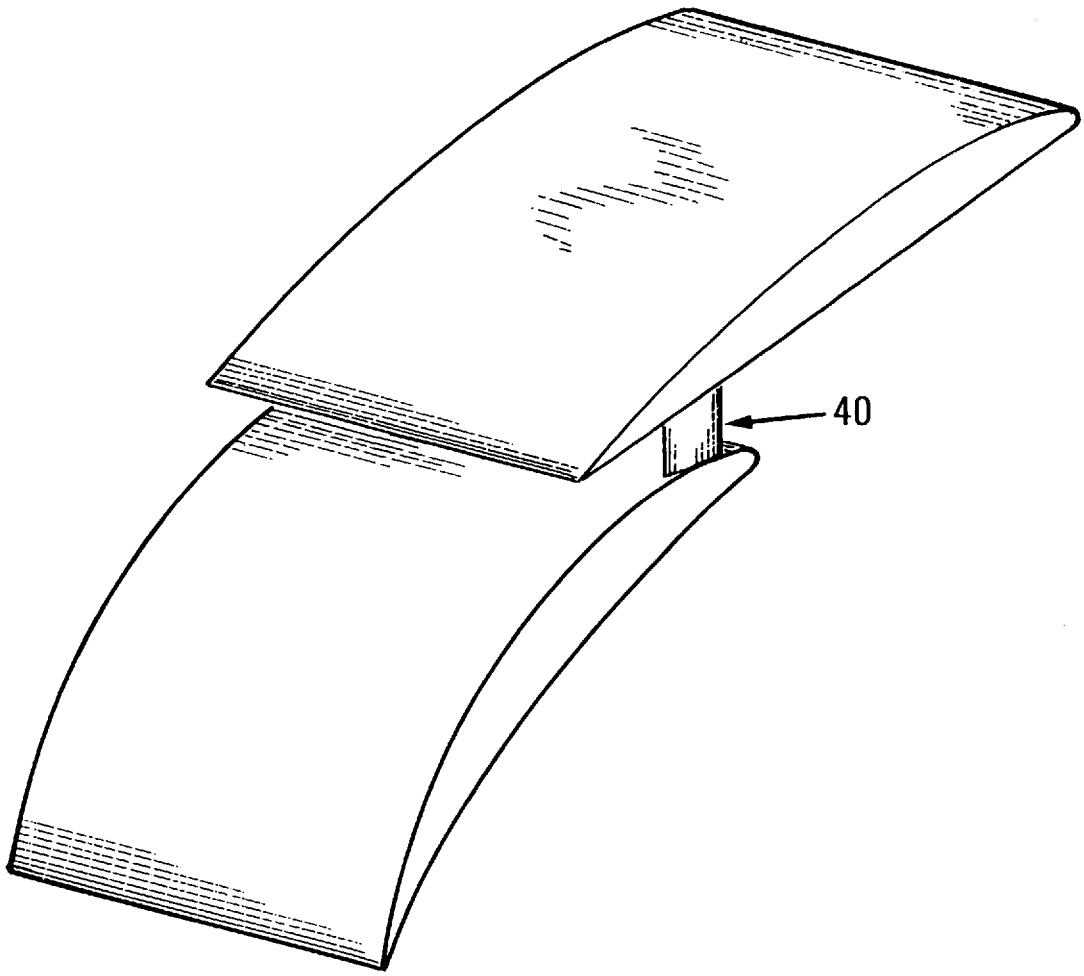

FIG. 5 is a sectional view in perspective of a group of blades connected for example each other with at least a mechanical elements. Thus, a first blade is for example connected to a following blade considering the direction of flow and/or to a previous blade. This mechanical element 40 may be placed at any point alone the longitudinal direction and/or along the width of the blade. Several geometrical dimensions may be considered to realize this mechanical elements, all possible geometrical shapes that do not introduce perturbation in the flowing of the fluid.

Advantageously, the mechanical element keeps the distance between the blades, and thus the specific ordering of the blades relative to each other.

It allows a mechanical reinforcement to be obtained.

Figure 6:
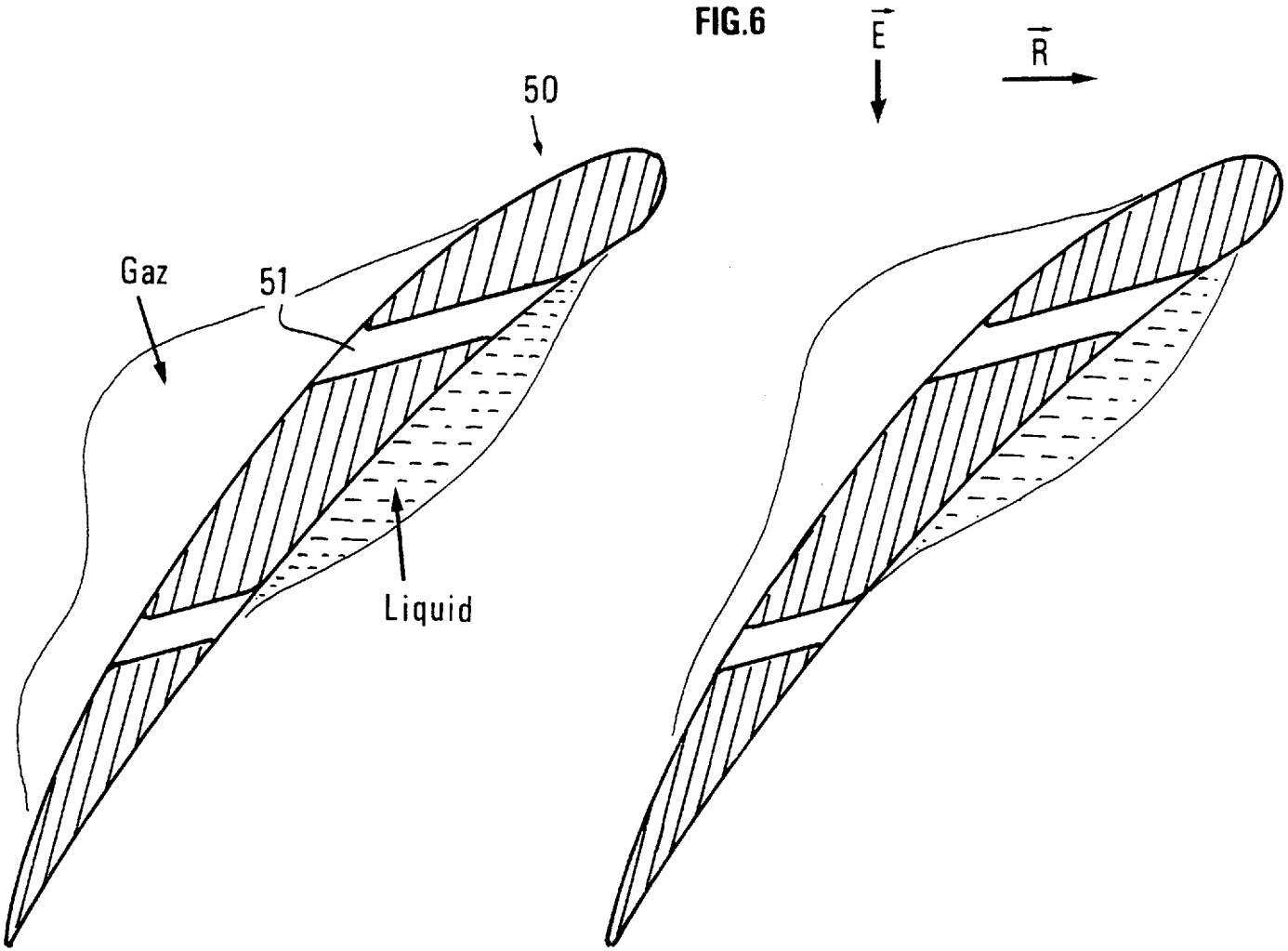
FIG. 6 is a simplistic embodiment of blades according to the invention provided with ports allowing to optimizing of phase mixtures.

FIG. 6 schematizes an embodiment variant of the device according to the invention where a group of blades is obtained from a blade provided with one or more ports distributed over at least part of its length. The parts of the blade separated by these ports thus form "sub-blades" having each a function substantially identical to the function of the blades $A_{ij}$ described in FIG. 3.

The openings or ports distributed along blade 50 thus allow passage of the liquid and gaseous fractions circulating respectively near to the lower face of the blade and to the top face of the blade, and coming from adjacent channels, as described in FIG. 3.

FIG. 6 shows a shape that can be taken by a gas pocket or a liquid pocket.

The liquid fraction tends to pass through at least one of the ports 51 so as to mix with the gas fraction circulating on the top face side and thus to forming of a multiphase mixture. The value of the GLR ratio is thus notably decreased as a result of the enrichment of the gas fraction with a liquid part and the compression of the multiphase fluid is improved by compensating the separation resulting from the multiphase fluid separation stage as described above in connection with FIG. 4.

The mixing openings or ports can have different geometries and dimensions selected notably according to the nature of the phases forming the fluid so as to facilitate the passage of these phases towards each other.

We claim:

1. A device for providing one of compressing and pumping of a multiphase fluid including at least one liquid phase and at least one gaseous phase comprising:

at least one hollow casing having at least one inlet port and at least one outlet port for the fluid;

at least one rotor rotatably mounted inside the casing having an axis of rotation Ox and a hub; and wherein the at least one rotor comprises at least one impeller having at least two vanes Gj having a first blade $A_{ij}$ and a second blade $A_2$j, wherein geometric characteristics and positioning of at least one of the first blade $A_{1j}$ and at least one of the second blade $A_{2j}$ in relation to each other are determined according to at least one parameter selected from the parameters 1–4 as follows:

parameter 1: a tangential offset h in relation to a pitch t, expressed in the form of the ratio h/t, wherein t is the pitch corresponding to a distance between two trailing edges $f_{21}$ and $f_{22}$ corresponding to each second blade $A_{21}$ and $A_{22}$ of at least one vane, the value of parameter 1 ranging between 0.95 to 1.05, parameter 2: a ratio of axial lap $r_j$ and of a total chord $C_{Tj}$ corresponding to at least one vane ranging between 0.01 to 0.15, parameter 3: a chord ratio $R_{Cj}=(C_{Fj}/C_{Rj})$ defined, for at least one vane, by a ratio of a value of a chord $C_{Fj}$ of the first blade to the value of a chord $C_{Rj}$ of a second blade of at least one vane ranging between 0.5 to 1.5, and parameter 4: a camber ratio $\Theta_j$ defined by a value of the camber $\Theta_{Fj}$ of the first blade to the value of a camber $\Theta_{Rj}$ of the second blade of at least one vane ranging between 0.10 to 1.0.

2. A device as claimed in claim 1 further comprising, at least one of an impeller and at least one diffuser with each impeller comprising at least first and second vanes with the first vane comprising a first blade $A_{11}$ and a second blade $A_{12}$ and the second vane comprising a first blade $A_{21}$ and a second blade $A_{22}$, wherein geometric characteristics and positioning of the first and second vanes in relation to each other are determined according to parameters 1–3.

3. A device as claimed in claim 2 wherein:

a ratio e1/e2 of a maximum thickness of at least one of the first blade $A_{1j}$ and the second blade $A_{2j}$ ranges between 0.5 and 1.0 for the at least one impeller and the at least one diffuser.

4. A device as claimed in claim 2 wherein:

a thickness of e1 of the first blade $A_{1j}$ ranges between 2 and 10 mm and a thickness of e2 of the second blade $A_{2j}$ ranges between 2 and 20 mm.

5. A device as claimed in claim 1, wherein:

a ratio of e1/e2 of a maximum thickness of at least one of the first blade $A_{1j}$ and the second blade $A_{2j}$ ranges between 0.5 and 1 for the at least one impeller.

6. A device as claimed in claim 1 wherein:

a thickness of e1 of the first blade $A_{1j}$ ranges between 2 and 10 mm and a thickness of e2 of the second blade $A_{2j}$ ranges between 2 and 20 mm.

7. A device as claimed in claim 1 further comprising:

at least one impeller and at least one diffuser each disposed in a hollow casing of the at least one hollow casing, the impeller being placed before the diffuser relative to a direction of flow of the fluid through the device.

8. A device in accordance with claim 1 further comprising:

at least one opening extending between opposed faces of at least one of the first blade $A_{1j}$ and the second blade $A_{2j}$ to allow passage of the multiphase fluid through the at least one opening.

9. A device in accordance with claim 1 wherein:

each vane $G_j$ comprises a first blade $A_{1j}$ and a second blade $A_2$j separated from each other and attached to the hub which blades are contacted by the at least one liquid phase and the at least one gaseous phase along a length of the blades parallel to the hub, each blade having a leading edge $a_{ij}$ and a trailing edge $f_{ij}$, an angle a formed by a tangent to a curve of a skeleton of the blades with a plane normal to an axis of rotation of the rotor, the angle a being defined from the leading edge $a_{ij}$ of at least one of the first and second blades $A_{1j}$ and $A_{2j}$ between 0° and 45°.

10. A device for providing one of compressing and pumping of a multiphase fluid including at least one liquid phase and at least one gaseous phase comprising:

at least one hollow casing having at least one inlet port and at least one outlet port for the fluid;

at least one rotor rotatably mounted inside the casing having an axis of rotation Ox and a hub; and wherein the at least one rotor comprises at least one diffuser with each diffuser having a first blade $A_{ij}$ and a second blade $A_{2j}$, wherein geometric characteristics and positioning of at least one of the first blade $A_{1j}$ and the second blade $A_{2j}$ in relation to each other are determined according to at least one parameter selected from the parameters 1–4 as follows:

parameter 1: a tangential offset h in relation to a pitch t, expressed in the form of the ratio h/t, where t is the pitch corresponding to the distance between the two trailing edges $f_{21}$ and $f_{22}$ corresponding to each second blade $A_{21}$ and $A_{22}$ of at least one vane, the value of parameter 1 ranging between 0.60 to 0.80 range, parameter 2: a ratio of axial lap $r_j$ and of a total chord $C_{Tj}$ corresponding to at least one vane ranging between −0.01 to 0.05, parameter 3: a chord ratio $R_{Cj}=(C_{Fj}/C_{Rj})$ defined, for at least one vane, by a ratio of a value of a chord $C_{Fj}$ of the first blade to the value of a chord $C_{Rj}$ of a second blade of at least one vane ranging between 0.5 to 1.5, and parameter 4: a camber ratio $\Theta_j$ defined by a value of the camber $\Theta_{Fj}$ of the first blade to the value of a camber $\Theta_{Rj}$ of the second blade of at least one vane ranging between 0.10 to 1.0.

11. A device as claimed in claim 10 further comprising, at least one of an impeller and at least one diffuser with each diffuser comprising at least first and second vanes with the first vane comprising a first blade $A_{11}$ and a second blade $A_{12}$ and the second vane comprising a first blade $A_{21}$ and a second blade $A_{22}$, wherein geometric characteristics and positioning of the first and second vanes in relation to each other are determined according to parameters 1–3.

12. A device as claimed in claim 10 wherein:

a ratio e1/e2 of a maximum thickness of at least one of the first blade $A_{1j}$ and the second blade $A_{2j}$ ranges between 0.5 and 1.0 for the at least one diffuser.

13. A device as claimed in claim 10 wherein:

a thickness of e1 of the first blade $A_{1j}$ ranges between 2 and 10 mm and a thickness of e2 of the second blade $A_{2j}$ ranges between 2 and 20 mm.

14. A device as claimed in claim 10 further comprising:

at least one impeller and at least one diffuser each disposed in a hollow casing of the at least one hollow casing, the impeller being placed after the diffuser relative to a direction of flow of the fluid through the device.

15. A device in accordance with claim 10 further comprising:

at least one opening extending between opposed faces of at least one of the first blade $A_{1j}$ and the second blade $A_{2j}$ to allow passage of the multiphase fluid through the at least one opening.

16. A device in accordance with claim 10 wherein:

each vane $G_j$ comprises a first blade $A_{1j}$ and a second blade $A_{2j}$ separated from each other and attached to the hub which blades are contacted by the at least one liquid phase and the at least one gaseous phase along a length of the blades parallel to the hub, each blade having a leading edge $a_{ij}$ and a trailing edge $f_{ij}$, an angle a formed by a tangent to a curve of a skeleton of the blades with a plane normal to an axis of rotation of the rotor, the angle a being defined from the leading edge $a_{ij}$ of at least one of the first and second blades $A_{ij}$ and $A_{2j}$ between 0° and 45°.

* * * * *